US005769673A

United States Patent [19]

Ohta et al.

[11] Patent Number: 5,769,673

[45] Date of Patent: Jun. 23, 1998

[54] FEMALE TERMINAL

[75] Inventors: Yukio Ohta; Takeya Miwa, both of Shizuoka, Japan

[73] Assignee: Yazaki Corporation, Tokyo, Japan

[21] Appl. No.: 679,490

[22] Filed: Jul. 12, 1996

[30] Foreign Application Priority Data

Jul. 12, 1995 [JP] Japan ..... 7-176288

[51] Int. Cl.[6] ..... H01R 11/22

[52] U.S. Cl. ..... 439/852; 439/862

[58] Field of Search ..... 439/852, 849, 439/850, 851, 842, 843, 862, 839, 858

[56] References Cited

U.S. PATENT DOCUMENTS

| | | | |
|---|---|---|---|
| 4,696,530 | 9/1987 | Vandame | 439/266 |
| 5,480,320 | 1/1996 | Saimoto | 439/852 |
| 5,540,603 | 7/1996 | Fujiwara | 439/851 |
| 5,551,150 | 9/1996 | Zielinski et al. | 439/852 |

FOREIGN PATENT DOCUMENTS

| | | | |
|---|---|---|---|
| 1106084 | 7/1989 | Japan | H01R 13/115 |

*Primary Examiner*—Neil Abrams
*Assistant Examiner*—Tho Dac Ta
*Attorney, Agent, or Firm*—Sughrue, Mion, Zinn, Macpeak & Seas, PLLC

[57] ABSTRACT

A female terminal in which excessive flexing of a resilient contact piece portion is prevented by simple working. The female terminal of the invention includes deformation prevention folded portions which are bent respectively at opposite side portions of a second folded piece portion toward a first folded piece portion. The deformation prevention folded portion supports the first folded piece portion in a maximumly-flexed position of the first folded piece portion. When a male terminal, having a proper thickness, is inserted into the female terminal, a predetermined gap is formed between the first folded piece portion and the deformation prevention folded portion. Even when the first folded piece portion is flexed upon insertion of a thick foreign object into a hollow contact portion or upon prizing of the first folded piece portion in the hollow contact portion, the deformation prevention folded portion supports the first folded piece portion in the maximumly-flexed position thereof, and therefore a resilient contact piece portion will not be permanently deformed. And besides, the deformation prevention folded portion can be formed by simple working.

11 Claims, 6 Drawing Sheets

FEMALE TERMINAL

BACKGROUND OF THE INVENTION

1. Field of the Invention

This invention relates to a female terminal having a resilient contact piece portion provided within a hollow contact portion.

2. Background

FIG. 7 shows a female terminal 1. This female terminal 1 includes a hollow contact portion 5 formed at one end thereof, and a wire connecting portion 7 integrally formed at the other end thereof, and the hollow contact portion 5 has a flat bottom plate portion 3, and the wire connecting portion 7 is formed integrally with the hollow contact portion 5. A resilient contact piece portion 9, folded back from a distal end 3*a* of the bottom plate portion 3, is provided within the hollow contact portion 5. A mating terminal (plate-like male terminal) can be inserted between the resilient contact piece portion 9 and a top plate portion 11 of the hollow contact portion 5.

The resilient contact piece portion 9 includes a first folded piece portion 15, folded back from the distal end 3*a* of the bottom plate portion 3 toward the wire connecting portion 7, and a second folded piece portion 17 folded back from a distal end of the first folded piece portion 15 toward the distal end of the bottom plate portion 3 and lying between the first folded piece portion 15 and the bottom plate portion 3.

As shown in FIG. 8, the female terminal 1 is received in a terminal receiving chamber 21 formed in a connector housing 19, and is engaged with an elastic retaining arm 23 to be prevented from withdrawal from the terminal receiving chamber 21. In this condition, when the mating terminal 13 is inserted into the hollow contact portion 5 through a hole in the connector housing 19, the mating terminal 13 is fitted between the first folded piece portion 15 and the top plate portion 11, and is resiliently held therebetween with a predetermined contact pressure, thus achieving an electrical connection therebetween.

However, if a foreign object 25 larger in thickness than the mating terminal 13 is inserted into the hollow contact portion 5 as shown in FIG. 9, the resilient contact piece portion 9 is excessively flexed or bent, and is permanently deformed. Also, if a foreign object 27 smaller in thickness than the mating terminal 13 is inserted into the hollow contact portion 5 in an inclined manner as shown in FIG. 10, the resilient contact piece portion 9 is excessively flexed, and is permanently deformed. Further, if the resilient contact piece portion 9 is prized or pried by a screw driver 28 or the like, for example, in a process by a car maker or by a car dealer (see FIG. 11), there is a possibility that the resilient contact piece portion 9 is excessively flexed to be permanently deformed and damaged. In such a case, when the proper mating terminal 13 is inserted, it can not be resiliently held between the resilient contact piece portion 9 and the top plate portion 11, so that the reliability of the electrical connection through this contact is adversely affected.

Under the circumstances, Unexamined Japanese Utility Model Publication No. 1-106084 proposes a female terminal 31 of such a construction that a resilient contact piece portion 29 is prevented from excessive flexing. As shown in FIG. 12, in this female terminal 31, opposite side portions of the resilient contact piece portion 29 adjacent to its free end are bent toward a bottom plate portion 33 to form rear prizing prevention portions 35, and each rear prizing prevention portion 35 is further bent at its lower portion to form an auxiliary resilient piece portion 37 underlying the resilient contact piece portion 29 and extending from the rear prizing prevention portion 35 toward the proximal end of the resilient contact piece portion 29. The distance between the auxiliary resilient piece portion 37 and the resilient contact piece portion 29 is larger at the distal end of the auxiliary resilient piece portion 37 than at the rear prizing prevention portion 35, and the distal end of the auxiliary resilient piece portion 37 is held against the bottom plate portion 33. Further, the distal end portion of the auxiliary resilient piece portion 37 is bent toward the resilient contact piece portion 29 to form a front prizing prevention portion 39 spaced a predetermined distance from the resilient contact piece portion 29.

Against a thick foreign objection and a prizing action, the rear prizing prevention portions 35 and the front prizing prevention portions 39 prevent the resilient contact piece portion 29 from being excessively flexed, thereby preventing permanent deformation of the resilient contact piece portion 29, thus enhancing the reliability of the electrical connection.

However, in the female terminal 31 disclosed in the above publication, the distal end portion of the auxiliary resilient piece portion 37 is bent to form the front prizing prevention portion 39 having a small size L2, and therefore if the length L1 of the auxiliary resilient piece portion 37 is short, it is difficult to bend the front prizing prevention portion 39 by pressing, and much time and labor are required for the manufacture. If the length L1 of the auxiliary resilient piece portion 37 is long, a sufficient strength, acting against a force directed toward the bottom plate portion 33, can not be obtained structurally. Namely, since it is difficult to provide and maintain the perpendicularity between the sheet material (having a thickness, for example, of 0.2 mm or 0.25 mm) and the bottom plate portion 33, it is difficult to bring the auxiliary resilient piece portion 37 into complete contact with the bottom plate portion 33.

SUMMARY OF THE INVENTION

It is therefore an object of this invention to provide a female terminal in which excessive flexing of a resilient contact piece portion is prevented by simple working.

To achieve the above object, the invention provides a female terminal including a resilient contact piece portion provided within a hollow contact portion having a flat bottom plate portion, the resilient contact piece portion including a first folded piece portion, folded back from a distal end of the bottom plate portion, and a second folded piece portion folded back from a distal end of the first folded piece portion toward the distal end of the bottom plate portion and lying between the first folded piece portion and the bottom plate portion; in which there is provided a deformation prevention folded portion which is bent at at least one side portion of the second folded piece portion toward the first folded piece portion; the deformation prevention folded portion supports the first folded piece portion in a maximumly-flexed position of the first folded piece portion; and when a male terminal, having a proper thickness, is inserted into the hollow contact portion, a predetermined gap is formed between the first folded piece portion and the deformation prevention folded portion.

Therefore, when a load is applied to the resilient contact piece portion to flex the same upon insertion of a thick foreign object into the hollow contact portion or upon prizing of the resilient contact piece portion in the hollow contact portion, the deformation prevention folded portion supports the resilient contact piece portion in the maximumly-flexed portion. Therefore, excessive flexing of the resilient contact piece portion is prevented, and permanent deformation thereof is prevented. When the mating terminal, having the proper thickness, is inserted into the hollow contact portion, the predetermined gap is formed between the deformation prevention folded portion and the first folded piece portion, and in the maximumly-flexed position of the resilient contact piece portion, this gap is eliminated.

The deformation prevention folded portion is disposed in overlying and overlapping relation to the second folded piece portion.

Therefore, the deformation prevention folded portion is easily formed by folding the side portion of the second folded piece portion thereon. The deformation prevention folded portion firmly supports the first folded piece portion in the maximumly-flexed position thereof.

The deformation prevention folded portion is bent generally perpendicularly at the side portion of the second folded piece portion toward the first folded piece portion, and has such a height as to support the first folded piece portion in the maximumly-flexed position of the first folded piece portion.

Therefore, the deformation prevention folded portion is formed by bending the side portion of the second folded piece portion.

The deformation prevention folded portion includes folded half portions which are folded respectively at the opposite side portions of the second folded piece portion.

Therefore, the deformation prevention folded portion can be easily formed by folding the folded half portions.

DETAILED DESCRIPTION OF THE PREFERRED EMBODIMENTS

Figure 1:
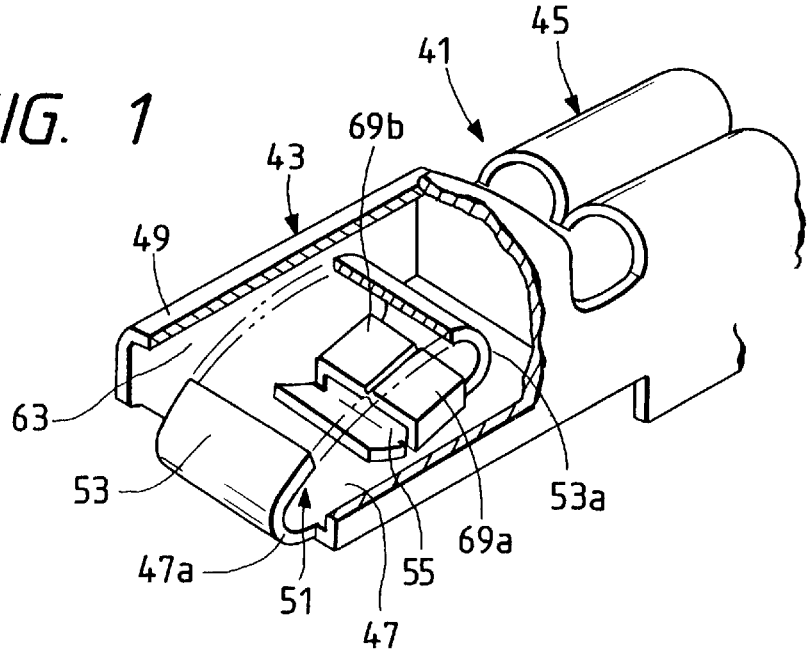
FIG. 1 is a partly-broken, perspective view of a preferred embodiment of a female terminal of the invention.
Figure 2A:
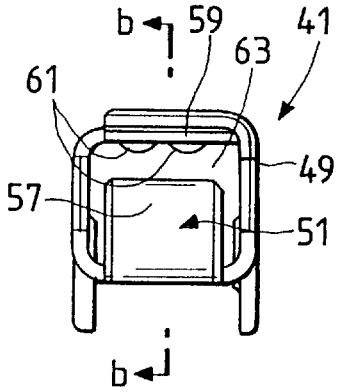
FIG. 2*a* is a front-elevational view of the female terminal of the invention.
Figure 2B:
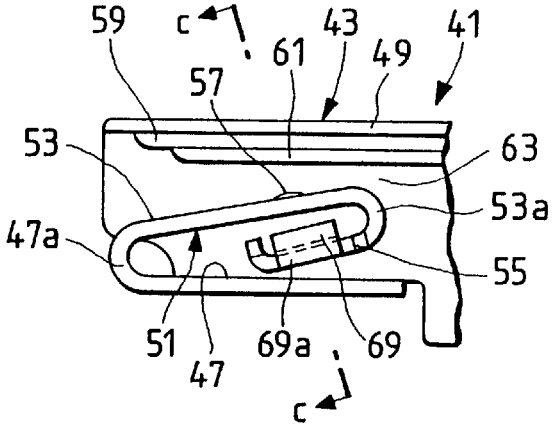
FIG. 2*b* is a cross-sectional view taken along the line b—b of FIG. 2*a*.
Figure 2C:
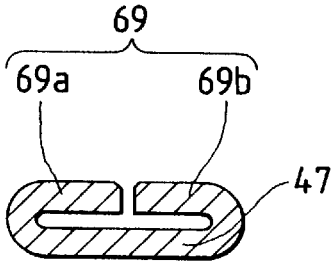
FIG. 2*c* is a cross-sectional view taken along the line c—c of FIG. 2*b;*

A preferred embodiment of a female terminal of the present invention will now be described with reference to the drawings. FIG. 1 is a partly-broken, perspective view of the female terminal 41, showing the interior thereof, and FIGS. 2*a* to 2*c* show an electrical contact portion 43 of the female terminal 41, and more specifically FIG. 2*a* is a front-elevational view thereof, FIG. 2*b* is a cross-sectional view taken along the line b—b of FIG. 2*a*, and FIG. 2*c* is a cross-sectional view taken along the line c—c of FIG. 2*b*.

As shown in FIG. 1, the female terminal 41 includes the electrical contact portion 43 formed at one end thereof, and a wire connecting portion 45 integrally formed at the other end thereof. The electrical contact portion 43 includes a hollow contact portion 49 having a flat bottom plate portion 47, and a resilient contact piece portion 51, folded back from a distal end 47*a* of the bottom plate portion 47, is provided within the hollow contact portion 49.

The resilient contact piece portion 51 includes a first folded piece portion 53, folded back from the distal end 47*a* of the bottom plate portion 47 toward the wire connecting portion 45, and a second folded piece portion 55 folded back from a distal end 53*a* of the first folded piece portion 53 toward the distal end 47*a* of the bottom plate portion 47 and lying between the first folded piece portion 53 and the bottom plate portion 47. As shown in FIGS. 2*a* and 2*b*, within the hollow contact portion 49, the first folded piece portion 53 is slanting upwardly toward the electrical contact portion 43, and the second folded piece portion 55 is slanting downwardly toward the distal end 47*a* of the bottom plate portion 47. A contact projection 57 is formed on an upper surface of the first folded piece portion 53, and a predetermined gap 63 is formed between the contact projection 57 and contact projections 61 formed on a top plate 59 of the hollow contact portion 49. A mating male terminal 65 is inserted into this gap 63.

In the female terminal 41 of this embodiment, a deformation prevention folded portion 69 includes folded half portions which are folded respectively at opposite side portions of the second folded piece portion 55 to be disposed between the first folded piece portion 53 and the second folded piece portion 55, and the deformation prevention folded portion 69 serves to support the first folded piece portion 53 in a maximumly-flexed position thereof. When the male terminal 65 with a proper thickness is inserted, a predetermined gap 67 is formed between the deformation prevention folded portion 69 and the first folded piece portion 53. The deformation prevention folded portion 69 thus includes folded half portions 69*a* and 69*b* folded respectively at the opposite side portions of the second folded piece portion 55.

A distal end portion of the second folded piece portion 55 is bent into an arcuate shape toward the first folded piece portion 53.

Figure 3:
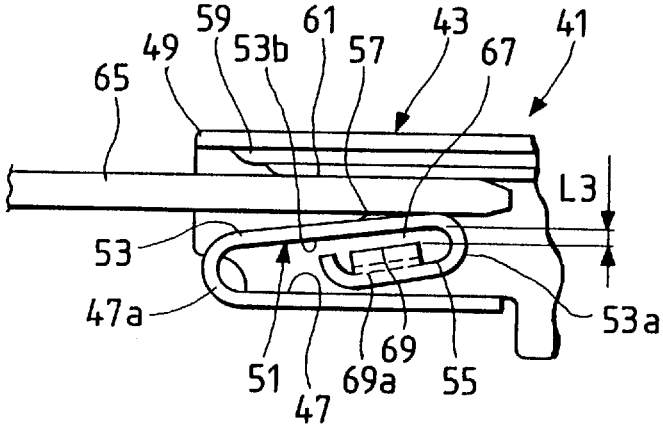
FIG. 3 is a cross-sectional view showing a condition in which a mating male terminal is inserted in a hollow contact portion of the female terminal.

As shown in FIG. 3, when the mating male terminal 65, having the proper thickness, is inserted into the hollow contact portion 49, the first folded piece portion 53 is flexed or turned toward the bottom plate portion 47 about the distal end 47*a*, and at this time the second folded piece portion 55 is flexed, with the distal end portion of the second folded piece portion 55 sliding over the bottom plate portion 47. In this condition, the gap 67, having a height L3, is formed between the deformation prevention folded portion 69 and the lower surface of the first folded piece portion 53.

Explanation will be made of the case where a foreign object larger in thickness than the mating male terminal 65 is inserted into the hollow contact portion 49 of the female terminal 41, or the case where the resilient contact piece portion is prized or pried by a foreign object inserted into the hollow contact portion 49.

Figure 4:
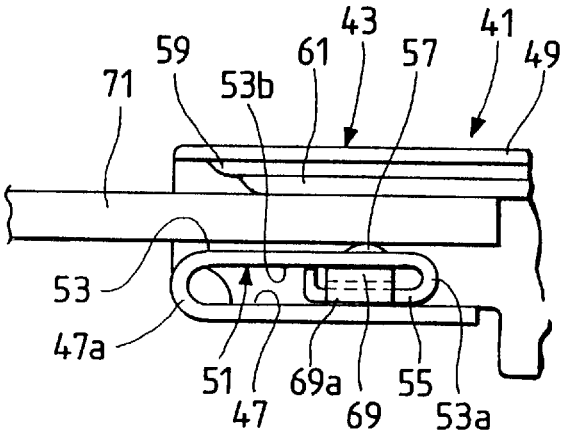
FIG. 4 is a cross-sectional view showing a condition in which a thick foreign object is inserted in the hollow contact portion.

As shown in FIG. 4, when a foreign object 71 larger in thickness than the mating male terminal 65 is inserted into the hollow contact portion 47, the first folded piece portion 53 is flexed or turned toward the bottom plate portion 47 about the distal end 47*a*, and at this time the second folded piece portion 55 is flexed about the distal end 53*a*, with the arcuate distal end portion of the second folded piece portion 55 sliding over the bottom plate portion 47. Then, when the first folded piece portion 53 is flexed to the maximum degree, the deformation prevention folded portion 69 is held against the lower surface 53*b* of the first folded piece portion 53, and thus supports the first folded piece portion 53 in its maximumly-flexed position. The thickness of the foreign object 71 shown in FIG. 4 is generally equal to the height of the gap 63 between the contact projection 57 and the contact projection 61 in the maximumly-flexed condition of the first folded piece portion 53. Namely, a foreign object, having a thickness larger than the height of the gap 63 between the contact projections 61 and the contact projection 57 in the fully-flexed condition of the first folded piece portion 53, can not be inserted into the hollow contact portion 49. Therefore, FIG. 4 shows the condition in which the foreign object, having such maximum thickness that it can be inserted into the hollow contact portion 49, is inserted in the hollow contact portion 49.

Figure 5:
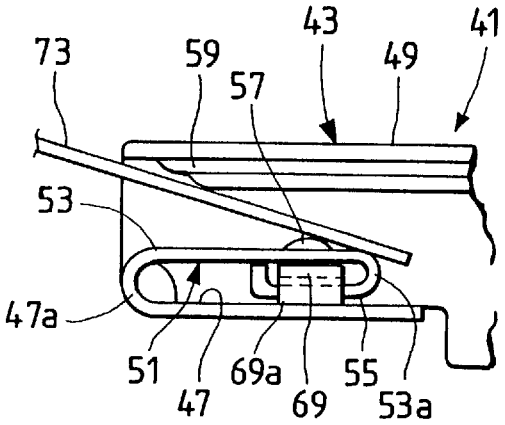
FIG. 5 is a cross-sectional view showing a condition in which a foreign object is inserted in the hollow contact portion, and prizes a resilient contact piece portion to flex the same.

As shown in FIG. 5, when a relatively thin foreign object 73 is inserted into the hollow contact portion 49, and is moved in a prized manner within the hollow contact portion 49, the first folded piece portion 53 is flexed toward the bottom plate portion 47. In this case, in the maximumly-flexed condition of the first folded piece portion 53, the deformation prevention folded portion 69 is held against the lower surface of the first folded piece portion 53, so that the first folded piece portion 53 is supported by the deformation prevention folded portion 69 in the maximumly-flexed position. Therefore, the first folded piece portion 53 will not be excessively flexed, and hence the resilient contact piece portion 51 will not be permanently deformed.

In this embodiment, since there is provided the deformation prevention folded portion 69 which supports the first folded piece portion 53 in the maximumly-flexed position thereof, the excessive flexing of the first folded piece portion 53 is positively prevented, and the resilient contact piece portion 51 will not permanently be deformed and damaged. Therefore, when the mating male terminal 65 is inserted into the hollow contact portion 49, this mating terminal can be resiliently retained within the hollow contact portion 49, and therefore the reliability of the connection is enhanced.

In this embodiment, the deformation prevention folded portion 69 is formed by folding the opposite side portions of the second folded piece portion 55 over the second fold piece portion 55 into facing relation to the first folded piece portion 53, and thus the sheet width of the second folded piece portion 55 is fully utilized, and therefore the working of the sheet is simple. Therefore, the manufacturing cost can be reduced.

In this embodiment, by increasing the length of the deformation prevention folded portion 69 (in the direction of insertion of the mating terminal 65), the area of supporting the first folded piece portion 53 is increased, and therefore the first folded piece portion 53 can be positively supported in its maximumly-flexed position.

Another embodiment will be described with reference to FIGS. 6*a* and 6*b*. A female terminal 75 of this embodiment has a deformation prevention folded portion 77 different in configuration from that of the preceding embodiment.

Figure 6A:
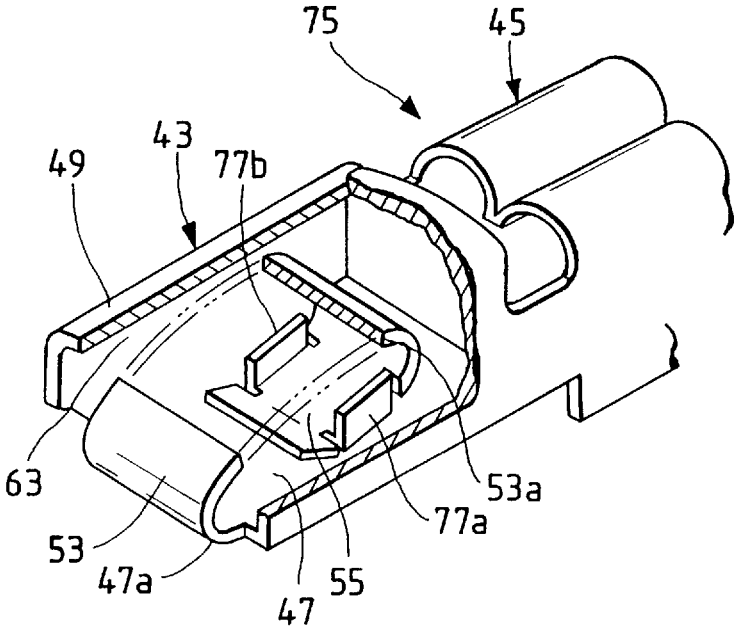
FIG. 6*a* is a partly-broken, perspective view of another preferred embodiment of a female terminal.
Figure 6B:
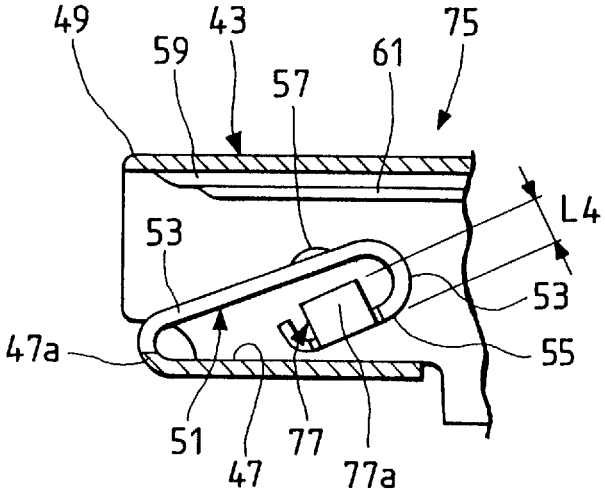
FIG. 6*b* is a cross-sectional view thereof.
Figure 7:
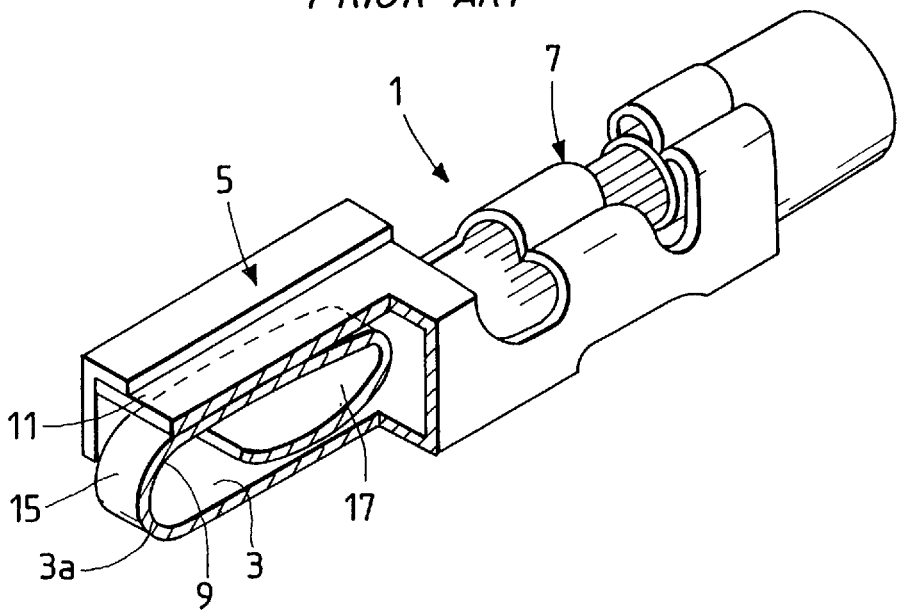
FIG. 7 PRIOR ART
FIG. 7 is a partly-broken, perspective view of a conventional female terminal.
Figure 8:
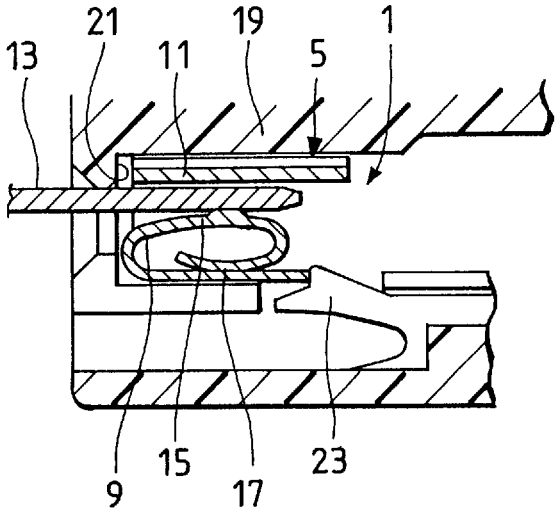
FIG. 8 PRIOR ART
FIG. 8 is a cross-sectional view showing a condition in which a mating male terminal is inserted in a hollow contact portion of the conventional female terminal.
Figure 9:
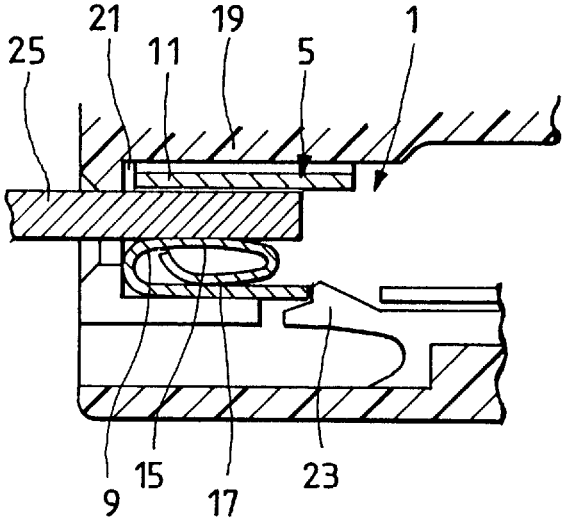
FIG. 9 PRIOR ART
FIG. 9 is a cross-sectional view showing a condition in which a thick foreign object is inserted in the hollow contact portion of the conventional female terminal.
Figure 10:
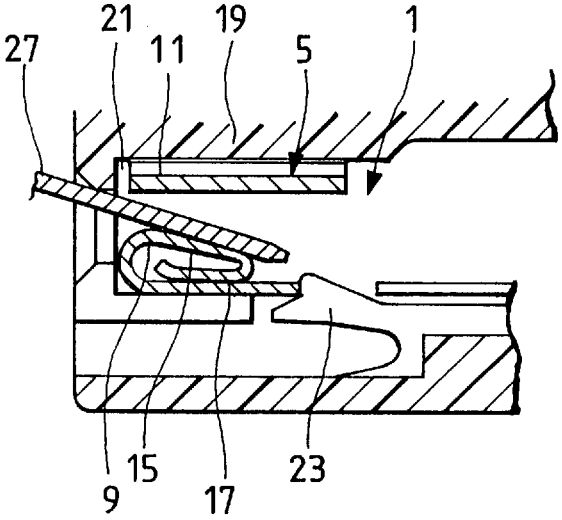
FIG. 10 PRIOR ART
FIG. 10 is a cross-sectional view showing a condition in which a foreign object is inserted in the hollow contact portion of the conventional female terminal, and prizes a resilient contact piece portion to flex the same.
Figure 11:
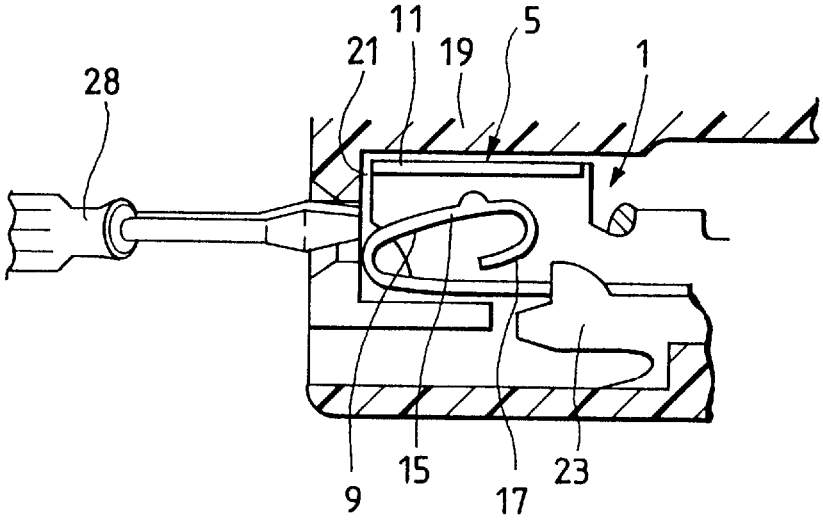
FIG. 11 PRIOR ART
FIG. 11 is a cross-sectional view showing a condition in which a screw driver is to be inserted into the hollow contact portion of the conventional female terminal.
Figure 12:
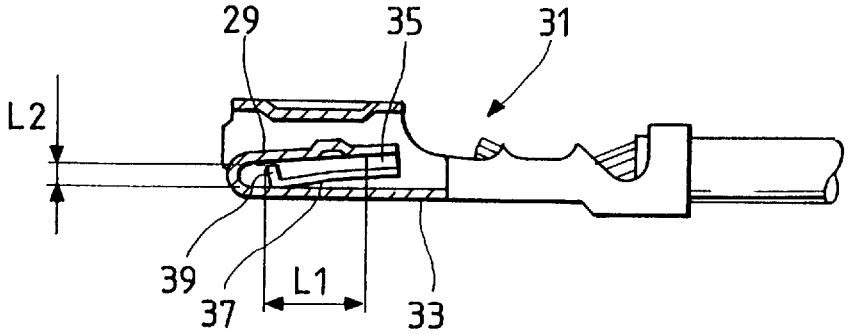
FIG. 12 PRIOR ART
FIG. 12 is a cross-sectional view showing the interior of another conventional female terminal.

As shown in FIG. 6*a*, in the female terminal 75 of this embodiment, the deformation prevention folded portion 77 includes folded half portions 77*a* and 77*b* which are formed respectively by generally perpendicularly bending opposite side portions of a second folded piece portion 55 toward a first folded piece portion 53. More specifically, in the female terminal 41 of the preceding embodiment, the deformation prevention folded portion is bent and folded into overlying and overlapping relation to the second folded piece portion 55, but in this embodiment the deformation prevention folded portion 77 is bent perpendicularly (or right-angularly) relative to the second folded piece portion 55. As shown in FIG. 6*b*, the deformation prevention folded portion 77 of this embodiment has a predetermined height L4. This height is so determined that when the first folded piece portion 53 is flexed toward a bottom plate portion 47 to the maximum degree, the deformation prevention folded portion 77 is held against the lower surface of the first folded piece portion 53 to support the same in the maximumly-flexed position.

In the female terminal 75 of this embodiment, also, similar effects as described for the female terminal 41 of the preceding embodiment are achieved, and even when the first folded piece portion 53 is flexed upon insertion of a thick foreign object into a hollow contact portion 49 or upon prizing of the first folded piece portion 53, the deformation prevention folded portion 77 positively supports the first folded piece portion 53 in the maximumly-flexed position thereof, and therefore permanent deformation of a resilient contact piece portion 51 is prevented.

The deformation prevention folded portion 77 of this embodiment is formed merely by generally perpendicularly bending the opposite side portions of the second folded piece portion 55 to form the folded half portions 77*a* and 77*b*, and therefore the deformation prevention folded portion 77 can be formed or shaped by simple working.

In the female terminals 41, 75, although the deformation prevention folded portions 69, 77 are formed by the folded half portions 69*a* and 69*b*, 77*a* and 77*b* folded respectively at the opposite side portions of the second folded piece portion 55, the deformation prevention folded portion may be formed by folding only one side portion of the second folded piece portion 55.

As described above, when a load is applied to the resilient contact piece portion to flex the same upon insertion of a thick foreign object into the hollow contact portion or upon prizing the resilient contact piece portion in the hollow contact portion, the deformation prevention folded portion is abutted against the first folded piece portion in the maximumly-flexed portion, and therefore excessive flexing of the resilient contact piece portion is prevented, and permanent deformation thereof is prevented. The deformation prevention folded portion is formed by folding the side portion of the second folded piece portion, and therefore it can be formed or shaped by simple working.

Further, the side portion of the second folded piece portion is folded to form the deformation prevention folded portion disposed in overlying and overlapping relation to the second folded piece portion, and therefore the deformation prevention folded portion can be formed or shaped by simple working. Since the deformation prevention folded portion is disposed in overlapping relation to the second folded piece portion, it can firmly support the first folded piece portion in the maximumly-flexed position thereof.

Furthermore, the deformation prevention folded portion is formed by bending the side portion of the second folded piece portion, and therefore the deformation prevention folded portion can be formed by simple working.

Furthermore, the deformation prevention folded portion is formed by the folded half portions folded respectively at the opposite side portions of the second folded piece portion, and therefore the deformation prevention folded portion can be formed or shaped by simple working.

What is claimed is:

1. A female terminal, comprising:

an electrically conductive plate including a wire connecting portion for clamping a wire thereto and a hollow contact portion for mating with a male terminal, said hollow contact portion including a flat bottom plate portion;

a resilient contact piece portion provided within said hollow contact portion, said resilient contact piece portion including a first folded piece portion folded back from a distal end of said bottom plate portion, and a second folded piece portion folded back from a distal end of said first folded piece portion toward the distal end of said bottom plate portion and lying between said first folded piece portion and said bottom plate portion; and a deformation prevention folded portion bent at a side portion of said second folded piece portion toward said first folded piece portion to form a first bend, wherein said deformation prevention folded portion supports said first folded piece portion in a predetermined flexed position of said first folded piece portion, and wherein when the male terminal is inserted into said hollow contact portion, a predetermined gap is formed between said first folded piece portion and said deformation prevention folded portion.

2. The female terminal of claim 1, wherein said deformation prevention folded portion supports said first folded piece portion in a maximumly-flexed position of said first folded piece portion.

3. The female terminal of claim 1, wherein said deformation prevention folded portion includes folded half portions which are folded respectively at the opposite side portions of said second folded piece portion.

4. The female terminal of claim 3, wherein distal end portions of said folded half portions confront each other.

5. The female terminal of claim 3, wherein at least one of said folded half portions of said deformation prevention folded portion further includes a distal end opposite said first bend and side faces between said distal end and said first bend, said second folded piece portion further includes a top face portion facing said first folded piece portion; and wherein one of said side faces of said at least one folded half portion is disposed in overlying and overlapping relation to said top face portion of said second folded piece portion.

6. The female terminal of claim 1, wherein said deformation prevention folded portion is disposed in overlying and overlapping relation to said second folded piece portion.

7. The female terminal of claim 6, wherein said deformation prevention folded portion includes folded half portions which are folded respectively at the opposite side portions of said second folded piece portion.

8. The female terminal of claim 7, wherein distal end portions of said folded half portions confront each other.

9. The female terminal of claim 1, wherein said deformation prevention folded portion is bent substantially perpendicularly at the side portion of said second folded piece portion toward said first folded piece portion, and has such a height as to support said first folded piece portion in a maximumly-flexed position of said first folded piece portion.

10. The female terminal of claim 9, wherein said deformation prevention folded portion includes folded half portions which are folded respectively at the opposite side portions of said second folded piece portion.

11. The female terminal of claim 10, wherein distal end portions of said folded half portions confront each other.

* * * * *